US012392082B2

(12) United States Patent
Davoudian

(10) Patent No.: US 12,392,082 B2
(45) Date of Patent: Aug. 19, 2025

(54) MULTIPOCKETED LAUNDRY ORGANIZATION DEVICE

(71) Applicant: Farzad Davoudian, Great Falls, VA (US)

(72) Inventor: Farzad Davoudian, Great Falls, VA (US)

( * ) Notice: Subject to any disclaimer, the term of this patent is extended or adjusted under 35 U.S.C. 154(b) by 95 days.

(21) Appl. No.: 18/204,338

(22) Filed: May 31, 2023

(65) Prior Publication Data

US 2023/0383460 A1 Nov. 30, 2023

Related U.S. Application Data

(60) Provisional application No. 63/347,237, filed on May 31, 2022.

(51) Int. Cl.
*D06F 95/00* (2006.01)
*B65D 30/00* (2006.01)
*B65D 33/14* (2006.01)

(52) U.S. Cl.
CPC ..... *D06F 95/004* (2013.01); *B65D 29/00* (2013.01); *B65D 33/14* (2013.01)

(58) Field of Classification Search
CPC ..... D06F 95/004; B65D 29/00; B65D 33/14; B65D 31/12
USPC ..... 383/12, 39
See application file for complete search history.

(56) References Cited

U.S. PATENT DOCUMENTS

| | | | | |
|---|---|---|---|---|
| 2,129,857 | A * | 9/1938 | Metzger | A47G 25/005 248/95 |
| 4,401,219 | A * | 8/1983 | Mink | A45C 11/16 206/466 |
| 5,065,864 | A * | 11/1991 | Schmitt | A47G 25/54 190/110 |
| 5,209,344 | A * | 5/1993 | Smith | A45C 11/16 206/466 |
| 5,509,588 | A * | 4/1996 | Kimball | A47G 25/14 223/98 |
| 10,927,494 | B1 * | 2/2021 | Sayarat | A47G 25/14 |
| 2010/0193383 | A1 * | 8/2010 | Parness | A45C 3/004 206/288 |

* cited by examiner

*Primary Examiner* — Jes F Pascua

(57) ABSTRACT

A multipocketed laundry organization device is provided having an organizational section that may utilize a plurality of fabric sheets coupled together at a plurality of coupling locations. The plurality of coupling locations may at least in part define a shape of a plurality of pockets and each of the plurality of pockets may comprise a cavity and a closure element. The multipocketed laundry organization device may also utilize a hanging section having a fabric body. The fabric body may utilize at least one aperture and at least one load-bearing portion.

17 Claims, 5 Drawing Sheets

MULTIPOCKETED LAUNDRY ORGANIZATION DEVICE

CROSS-REFERENCE TO RELATED APPLICATIONS

This application claims priority to U.S. Provisional Patent Application Ser. No. 63/347,237, entitled "Multipocketed Laundry Organization Device," filed May 31, 2022. The contents of this application are hereby incorporated by reference in their entirety.

BACKGROUND OF THE INVENTION

The laundry organization market has witnessed substantial growth in recent years, driven by increasing consumer demands for practical and efficient laundry solutions. According to industry statistics, the domestic laundry care market is valued at several billion dollars annually and is projected to experience steady growth over the forecast period. This market expansion is primarily attributed to the rising urbanization, changing lifestyles, and the need for time-saving and space-efficient laundry solutions in an increasing work-from-home environment.

Currently, laundry organization products primarily consist of traditional laundry baskets, hampers, and storage bins. While these products offer basic functionality, they often lack the convenience and versatility desired by modern consumers. One common problem with existing laundry baskets and hampers is that they do not facilitate machine-washing and drying of clothes while keeping them organized. Consequently, users are required to transfer clothes from these containers to the washing machine, which can lead to a disorganized laundry process and potential loss of garments.

Moreover, many existing laundry organization products are not designed to maximize storage space in closets or other storage areas. This limitation often results in cluttered and untidy laundry rooms or living spaces, further adding to the inconvenience experienced by users. Therefore, there exists a need for an improved laundry organization device that can address these shortcomings and provide an efficient and space-saving solution for managing clean and dirty laundry.

Existing closet organization devices, such as hanging organizers or storage bags, fail to address the need for convenient machine-washing and drying, which is a significant drawback in modern laundry management. These conventional products are typically made of non-washable materials or lack the necessary design elements to withstand the rigors of machine laundering. As a result, users are often required to remove clothes from these organizers before washing, leading to time-consuming and cumbersome processes. Furthermore, the inability to clean the entire organization device along with the laundry load can result in hygiene concerns, as residual dirt or odors may accumulate over time. The limitations of existing closet organization devices highlight the demand for an innovative solution that combines efficient laundry organization with the convenience of machine-washing and drying, ensuring cleanliness and ease of use for the user.

In addition to the limitations regarding machine-washing and drying, current closet organization devices, as well as traditional laundry baskets, hampers, and storage bins, lack the versatility of being convertible between a closet-hung organizer and a folded dresser organizer. These existing products often offer a single-purpose design, forcing users to choose between either organizing their clothes in the closet or storing them in a dresser drawer. This lack of adaptability results in inefficient use of space and limits the flexibility of organizing laundry based on individual preferences or the available storage options in different living environments. There exists a clear market need for an innovative laundry organization device that can seamlessly transition between a hanging organizer in the closet and a neatly folded organizer in a dresser drawer, providing users with the freedom to choose the most suitable storage method for their specific requirements.

Existing machine-washable garment bags, while offering a means to protect delicate fabrics during laundering, often fail to effectively keep clothes separated, hindering thorough and sanitary washing as well as proper drying. These conventional garment bags typically feature a single compartment, resulting in garments becoming tangled and limiting the exposure of each item to water, detergent, and agitation. As a consequence, the removal of dirt, debris, and bacteria from individual garments is compromised, leading to suboptimal cleanliness and potential hygiene concerns. Moreover, inadequate separation during drying can result in a musty odor and the buildup of bacteria due to incomplete drying. The limitations of existing machine-washable garment bags underscore the necessity for an improved laundry organization device that offers multiple pockets for individual garment storage, ensuring optimal washing and drying conditions to achieve thorough cleanliness and maintain garment freshness.

Therefore, it would be advantageous to provide a laundry organization device that addresses the shortcomings of existing products and offers a comprehensive solution for efficient laundry management. Such a device should allow for machine-washing and drying of clothes while keeping them organized, eliminating the need for transferring garments between containers and ensuring a streamlined laundry process. Additionally, the device should offer the versatility of being convertible between a closet-hung organizer and a folded dresser organizer, maximizing storage options and adaptability to different living environments. Furthermore, to facilitate a more thorough and sanitary washing, the device should feature multiple pockets to keep clothes separated, ensuring optimal removal of dirt, debris, and bacteria. Moreover, the device should promote proper drying to prevent the development of musty odors and bacterial buildup. By providing these benefits, the laundry organization device not only enhances convenience and efficiency but also promotes cleanliness, hygiene, and garment longevity.

DETAILED DESCRIPTION OF THE INVENTION

Figure 1:
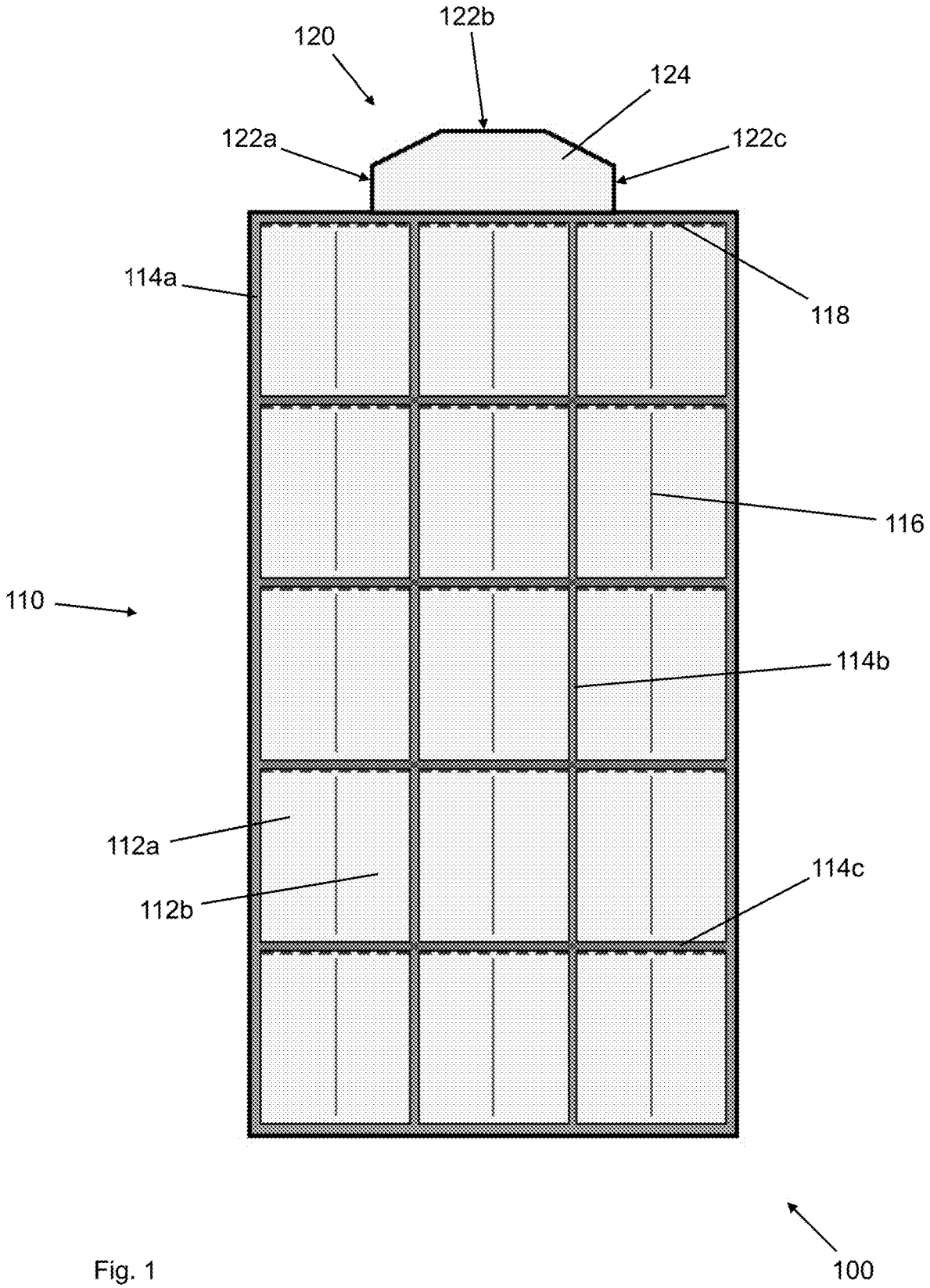
FIG. 1 illustrates a plan view of a multipocketed laundry organization device with a plurality of pockets arranged in three columns having a vertical seam bisecting each pocket with a closure element disposed at an upper portion thereof in accordance with some embodiments of the present invention.

Before describing the present invention in detail, it is to be understood that the invention is not limited to any one of the particular embodiments, which of course may vary. It is also to be understood that the terminology used herein is for the purpose of describing particular embodiments only, and therefore is not necessarily intended to be limiting. As used in this specification and the appended claims, terms in the singular and the singular forms "a," "an," and "the" include plural referents unless the context clearly dictates otherwise. Thus, for example, reference to "a multipocketed laundry organization device" also includes a plurality of multipocketed laundry organization devices and the like.

In some embodiments, a multipocketed laundry organization device is provided comprising an organizational section comprising a plurality of fabric sheets coupled together at a plurality of coupling locations, wherein the plurality of coupling locations at least in part define a shape of a plurality of pockets, and each of the plurality of pockets comprises a cavity and a closure element; and a hanging section comprising a fabric body, wherein the fabric body comprises at least one aperture and at least one load-bearing portion.

In some embodiments, the plurality of fabric sheets are coupled together by a plurality of stitch seams.

In some embodiments, one or more reinforcing members are disposed between the plurality of fabric sheets.

In some embodiments, the plurality of stitch seams couple the plurality of fabric sheets around the one or more reinforcing members.

In some embodiments, the plurality of stitch seams are disposed at the plurality of coupling locations.

In some embodiments, the organizational section further comprises one or more reinforcing members.

In some embodiments, the one or more reinforcing members are disposed along a peripheral edge of the organizational section.

In some embodiments, the one or more reinforcing members are disposed between rows of the plurality of pockets of the organizational section.

In some embodiments, the one or more reinforcing members are disposed between columns of the plurality of pockets of the organizational section.

In some embodiments, each of the plurality of pockets comprise a bisecting seam.

In some embodiments, the bisecting seam defines two pocket portions adjacent one another.

In some embodiments, the two pocket portions have equal dimensions.

In some embodiments, the cavity of each pocket is accessed via an opening in the closure element.

In some embodiments, the closure element comprises a closed state and an open state.

In some embodiments, the cavity is not accessible when the closure element is in the closed state, and the cavity is accessible via the opening when the closure element is in the open state.

In some embodiments, the opening only exists when the closure element is in the open state.

In some embodiments, the hanging section is permanently coupled to the organizational section.

In some embodiments, the hanging section is removably coupled to the organizational section.

In some embodiments, a multipocketed laundry organization device is provided comprising an organizational section comprising a plurality of fabric sheets coupled together at a plurality of coupling locations, wherein the plurality of coupling locations at least in part define a shape of a plurality of pockets, each of the plurality of pockets comprises a cavity and a closure element, the cavity of each pocket is accessed via an opening in the closure element, and the cavity of each pocket comprises at least one retention mechanism disposed therein; and a hanging section comprising a fabric body, wherein the fabric body comprises at least one aperture and at least one load-bearing portion.

In some embodiments, a multipocketed laundry organization device is provided, comprising an organizational section comprising a plurality of fabric sheets coupled together at a plurality of coupling locations, wherein the plurality of coupling locations at least in part define a shape of a plurality of pockets, and each of the plurality of pockets comprises a cavity and a closure element; and a hanging section comprising a fabric body, wherein the fabric body comprises at least one aperture and at least one load-bearing portion, the hanging section is coupled to the organizational section at a top peripheral edge of the organizational section, and the coupling of the hanging section to the organizational section in part defines a hanger cavity within the fabric body.

Exemplary embodiments of the present invention are illustrated in the accompanying figures. As shown in FIG. 1, a plan view of a multipocketed laundry organization device 100 with a plurality of pockets arranged in three columns having a vertical seam 116 bisecting each pocket with a closure element 118 disposed at an upper portion thereof is provided. The multipocketed laundry organization device 100 may comprise an organizational section 110 and a hanging section 120 such that the hanging section 120 may be permanently coupled to a top portion of the organizational section 110.

The organizational section 110 may comprise a plurality of pockets that may be defined by two sheets of fabric stitched together at locations that create the shape of the pockets. Specifically, each of the pockets may be bisected by a vertical seam 116 to create a first pocket portion 112*a* and a second pocket portion 112*b*. The vertical seam 116 may be stitching that couples the first and second fabric sheets together. Each of the first and second pocket portions 112*a*, 112*b* may comprise a cavity therein which each may be accessible via a closure element 118.

The closure element 118, as mentioned in the previous paragraph, is an important component of the multipocketed laundry organization device 100. The closure element 118 serves to secure the upper portion of each pocket, providing easy access to the cavity within. In various embodiments, the closure element 118 may be embodied as a zipper, magnetic closure, elastic closure, hook-and-loop fastener, or any other suitable fastening mechanism known in the art.

In terms of material fabrication, the closure element 118 can be made from a variety of materials depending on the desired functionality and durability. For instance, a zipper closure element may be fabricated from metal, plastic, or a combination thereof. A magnetic closure element may be composed of magnets embedded within fabric or other materials. An elastic closure element may be constructed using elastic bands or cords. Similarly, a hook-and-loop closure element may consist of hook-and-loop fastening material, such as Velcro, affixed to the device. The specific materials chosen for the closure element 118 may depend on factors such as strength, flexibility, ease of use, and compatibility with the overall construction of the multipocketed laundry organization device 100.

It should be noted that the choice of closure element 118 material and type may vary based on factors such as cost, availability, and desired performance characteristics. Those skilled in the art will appreciate that alternative closure mechanisms and material options may be employed to achieve the desired functionality of securing the pockets and providing access to the cavity within each pocket of the multipocketed laundry organization device 100.

The first and second pocket portions 112*a*, 112*b* of a given pocket of the plurality of pockets may be further defined by stitching around the exterior of the first and second pocket portions 112*a*, 112*b*. In order to robustly stitch the first and second fabric sheets together to form the plurality of pockets, one or more reinforcing members 114*a*, 114*b*, 114*c* may be utilized between the two fabric sheets. The one or more reinforcing members 114*a*, 114*b*, 114*c* may be separate members stitched together or may be a single unitary member. The outer reinforcing members 114*a* may be disposed along exterior peripheral edges of the organizational section 110 as shown in FIG. 1. The vertical reinforcing members 114*b* may be disposed vertically between columns of pockets in order to robustly stitch adjacent side edges of the pockets together. The horizontal reinforcing members 114*c* may be disposed horizontally between rows of pockets in order to robustly stitch adjacent top and bottom edges of the pockets together. Optionally, each of the vertical seams 116 may be formed by stitching that includes an additional set of reinforcing members between the first and second fabric sheets along the length of the seams 116.

The reinforcing members 114*a*, 114*b*, 114*c* play a crucial role in providing structural integrity and durability to the multipocketed laundry organization device 100. As described in the previous paragraphs, the reinforcing members 114*a*, 114*b*, 114*c* are utilized between the two fabric sheets to robustly stitch the first and second pocket portions 112*a*, 112*b* together, forming the plurality of pockets. These reinforcing members enhance the strength and stability of the device, ensuring its longevity and ability to withstand repeated use.

In various embodiments, the reinforcing members 114*a*, 114*b*, 114*c* may be embodied as strips or panels of more robust material compared to the fabric sheets. For example, the reinforcing members 114*a*, 114*b*, 114*c* may be made from materials such as canvas, nylon, polyester, or other suitable fabrics known for their strength and durability. These materials provide enhanced resistance to tearing or stretching, which is essential for maintaining the structural integrity of the device over time.

The reinforcing members 114*a*, 114*b*, 114*c* may be separate members stitched together or a single unitary member, depending on the specific design and manufacturing requirements. The outer reinforcing members 114*a* are positioned along the exterior peripheral edges of the organizational section 110, reinforcing the overall shape and providing additional strength to the device. The vertical reinforcing members 114*b* are located between columns of pockets, robustly stitching adjacent side edges of the pockets together, further enhancing the structural integrity. Similarly, the horizontal reinforcing members 114*c* are placed between rows of pockets, ensuring secure stitching of adjacent top and bottom edges of the pockets. Optionally, each of the vertical seams 116 may include an additional set of reinforcing members between the first and second fabric sheets along the length of the seams 116. These additional reinforcing members contribute to the overall strength of the seams, preventing them from becoming weak points in the construction of the device.

It should be understood that the choice of materials and design configuration for the reinforcing members 114*a*, 114*b*, 114*c* may vary based on factors such as cost, availability, desired performance characteristics, and the specific application of the multipocketed laundry organization device 100. Those skilled in the art will appreciate that alternative embodiments and variations of the reinforcing members may be employed within the scope of the invention.

The hanging section 120 may comprise a fabric body 124 that has a left side aperture 122*a*, a top aperture 122*b* and a right side aperture 122*c*. Between each of the left side aperture 122*a*, the top aperture 122*b* and the right side aperture 122*c* may be disposed load-bearing portions of the fabric body 124. Specifically, a first load-bearing portion of the fabric body 124 may be disposed between the left side aperture 122*a* and the top aperture 122*b* as illustrated by the upwardly-sloped portion therebetween. Further, a second load-bearing portion of the fabric body 124 may be disposed between the top aperture 122*b* and the right side aperture 122*c* as illustrated by the downwardly-sloped portion therebetween. The left side aperture 122*a*, the top aperture 122*b* and the right side aperture 122*c* may be utilized to allow a left side of a hanger, a top of a hanger and a right side of a hanger to be respectively disposed therethrough, thereby allowing the hanger to support the entire weight of the laundry organization device 100 via the load-bearing portions of the fabric body 124 in a manner a hanger would normally support a shirt via the apertures for the sleeves and the neck.

In an alternative embodiment, an adjustable strap attachment mechanism can be incorporated into the hanging section 120 of the multipocketed laundry organization device 100. The adjustable strap attachment allows the device to be securely attached to various types of hooks or rods, expanding its versatility in hanging options. By providing adjustable straps with fastening mechanisms such as buckles or hooks, users can easily adapt the device 100 to different hanging configurations, accommodating various storage spaces and environments.

Another alternative concept for the hanging section 120 involves the integration of detachable hanging hooks. These hooks are designed to be easily attached or removed from the device 100 as needed. With this feature, users have the flexibility to hang the device on a hanger or directly on a rod or hook without the requirement of additional attachments. The detachable hanging hooks provide convenience and versatility, enabling users to choose the most suitable hanging method for their specific needs.

To enhance the stability and weight-bearing capacity of the hanging section 120, reinforcing elements or inserts may be incorporated into the load-bearing portions of the fabric body 124. These reinforcements reinforce the structure of the hanging section, ensuring its ability to support the weight of the laundry organization device 100 even when loaded with heavy laundry items. By strategically placing reinforcing elements within the load-bearing portions, the device's overall durability and strength are increased, promoting long-lasting performance.

An alternative concept for the hanging section 120 involves the inclusion of additional pockets or compartments. Alongside the main pockets in the organizational section, the hanging section may feature a few smaller pockets or compartments. These additional pockets provide convenient storage for smaller items such as socks, accessories, or laundry supplies. By incorporating these extra pockets, the hanging section optimizes storage space and enhances the overall functionality of the device 100, allowing for the organized and secure storage of various laundry-related items.

In a different embodiment, the hanging section 120 may be designed to fold or collapse when not in use. This folding or collapsible feature enables the hanging section to be easily stored and transported, making the device more compact and convenient for travel or situations with limited storage spaces. By incorporating hinges, flexible materials, or a collapsible frame, the hanging section can be transformed into a more portable form, facilitating easy storage and enabling users to take the device 100 with them on the go.

The fabric utilized by the multipocketed laundry organization device 100 may be constructed from various fabric materials such as, but not limited to, nylon, polyester, polypropylene, and cotton. Nylon fabric offers lightweight durability and resistance to stretching and tearing, while polyester fabric provides excellent strength and stability. Polypropylene fabric offers chemical resistance and moisture resistance, making it suitable for specific environments. Cotton fabric offers breathability and a natural feel. The choice of material may depend on factors such as durability, breathability, and maintenance requirements, as well as the intended use of the laundry organization device 100.

The fabric of the multipocketed laundry organization device 100 may be formed in various mesh shapes, depending on the desired functionality and aesthetics. For example, square mesh provides a balanced and uniform appearance, allowing for efficient airflow and accommodating various sizes of items. Diamond mesh offers a visually appealing pattern while maintaining sufficient airflow. Hexagonal mesh provides strength and stability due to its interlocking structure. While the choice of mesh shape may depend on factors such as visual appeal, airflow requirements, and the intended use of the device 100, it would be advantageous to utilize square mesh in order to optimize for the most important factor of allowing for efficient fluid flow through the mesh pores during the machine washing and drying processes.

In terms of pore diameter, the fabric body of the multipocketed laundry organization device 100 may have varying pore sizes depending on the specific application. Larger pore diameters promote better airflow, allowing for ventilation and breathability. However, larger pore sizes may allow smaller items to slip through and may not be robust enough to iterative wear and tear. Smaller pore diameters provide better containment of items and structural durability, but may restrict airflow to some extent. The selection of an appropriate pore diameter should strike a balance between airflow and containment based on the desired functionality and the items intended to be stored. Pore diameters can range from a few millimeters to centimeters, depending on the specific requirements of the laundry organization device and the items it is designed to hold.

An advantageous range for the diameter of the pores in the mesh material of the laundry organization device would balance the need for aeration and the prevention of small clothing items from escaping. While the specific range may vary from the preferred range, an advantageous range for the pore diameter may be between 1 millimeter and 25 millimeters. Pore diameters within this range offer several advantageous benefits. For example, such pore diameters towards the 1 millimeter end of the range are still large enough to allow sufficient airflow and ventilation, promoting effective aeration of the clothes inside the device. This facilitates the circulation of air during machine washing and drying, helping to remove moisture and odors from the garments. At the same time, such pore diameters towards the 25 millimeter end of the range are still small enough to prevent small items from slipping through and getting lost during the washing and drying processes. Further, such pore diameters towards the 25 millimeter end still provide enough of a robust fabric thread count stability to support the load of carrying items within the pockets and the iterative machine washing and drying thereof. Such a range of pore diameters strikes optimizes the balance between allowing air and moisture penetration while maintaining the structural fabric durability of pockets or compartments of the laundry organization device during iterative use and machine washing and drying thereof.

Figure 2:
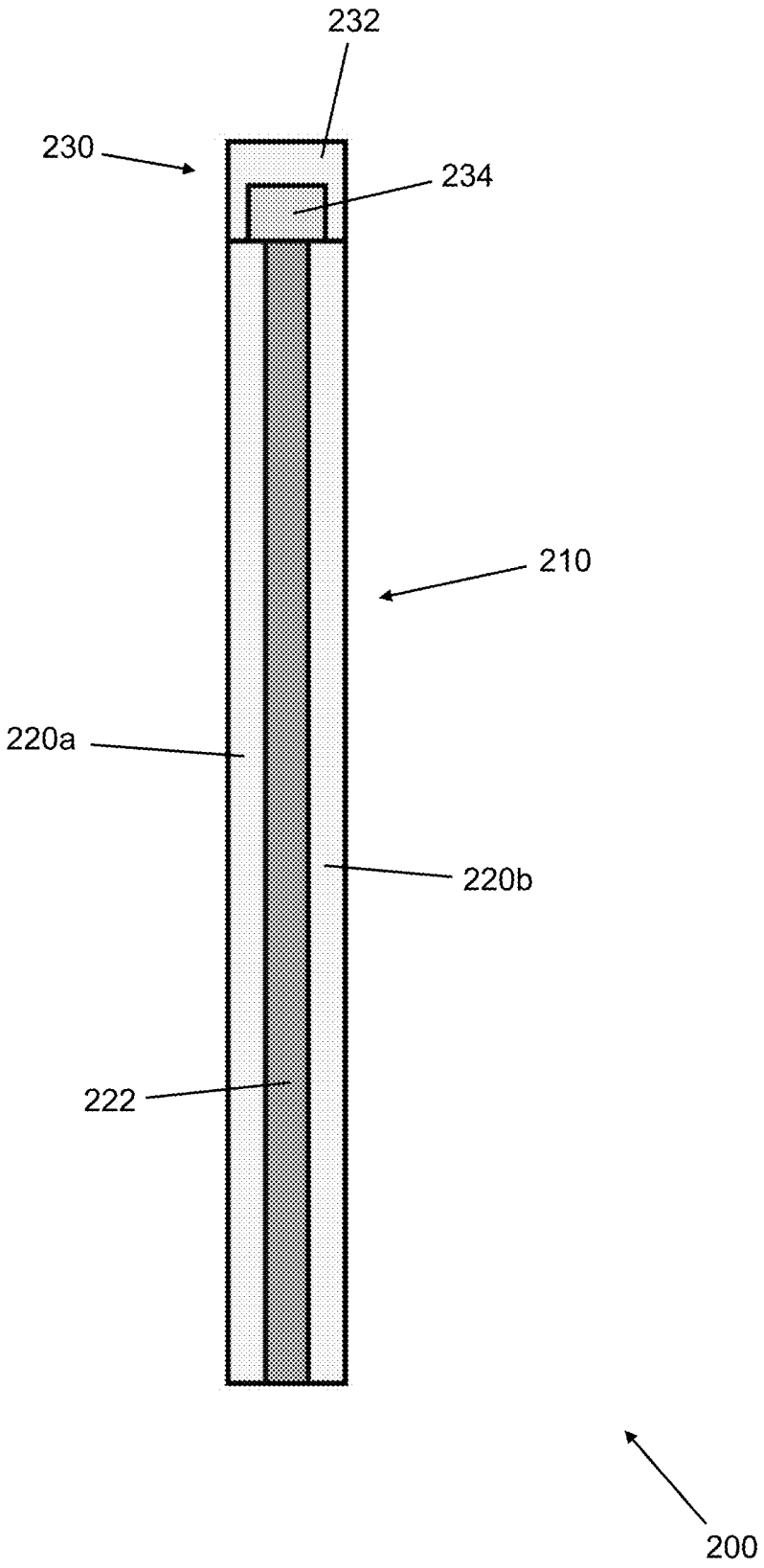
FIG. 2 illustrates a side view of a multipocketed laundry organization device with a plurality of fabric sheets and a reinforcing member in accordance with some embodiments of the present invention.

As shown in FIG. 2, a side view of a multipocketed laundry organization device 200 with a plurality of fabric sheets 220*a*, 220*b* and a reinforcing member 222 is provided. The multipocketed laundry organization device 200 may comprise an organizational section 210 and a hanging section 230 such that the hanging section 230 is permanently coupled to a top edge of the organizational section 210 and preferably coupled by stitching.

The plurality of fabric sheets 220*a*, 220*b* are shown in FIG. 2 in an enlarged width dimension for clarity and may be disposed on either side of the reinforcing member 222. It is understood that the reinforcing member 222 may not be disposed between the entirety of the fabric sheets 220*a*, 220*b* but rather only in the sections where it is desired to have stitching couple the fabric sheets 220*a*, 220*b* together to form a plurality of pockets as illustrated and described with reference to the multi pocked laundry organization device 100 of FIG. 1.

In certain embodiments, the reinforcing member 222 of the multipocketed laundry organization device 200 may be fabricated from common materials known for their strength and durability. Examples of suitable materials for the reinforcing members include nylon webbing, polyester webbing, canvas, polypropylene straps, and synthetic leather. Nylon webbing, known for its high tensile strength and abrasion resistance, provides robust support and reinforcement. Polyester webbing, with its excellent strength and resistance to stretching, ensures long-lasting durability. Canvas, a heavy-duty fabric, offers exceptional strength and is commonly used in products that require reliable reinforcement. Polypropylene straps, renowned for their lightweight and flexible nature, possess good tensile strength and resistance to moisture and chemicals. Synthetic leather, such as PVC or PU leather, can be employed to combine strength and aesthetics, providing both durability and an appealing appearance. The choice of material for the reinforcing members depends on factors such as the required strength, desired flexibility, resistance to moisture or chemicals, and the overall design of the multipocketed laundry organization device 200.

The hanging section 230 may comprise a fabric body 232 and one or more apertures 234 formed into the fabric body 232. While the fabric body 232 may be formed from the same material as the fabric sheets 220*a*, 220*b*, FIG. 2 is illustrated as differentiating between the two sections 210, 230 in order to illustrate that there is a stitch seam between the two sections 210, 230 which may be utilized as the means of permanently coupling the sections 210, 230 together. The one or more apertures 234 may be utilized to accept portions of a hanger in order to hang the multipocketed laundry organization device 200 in a closet. While only one aperture 234 is illustrated in FIG. 2 given the side view perspective, it is understood that a plurality of apertures 234 may be utilized in order to accept each corner of a hanger as well as the hook of the hanger.

Figure 3:
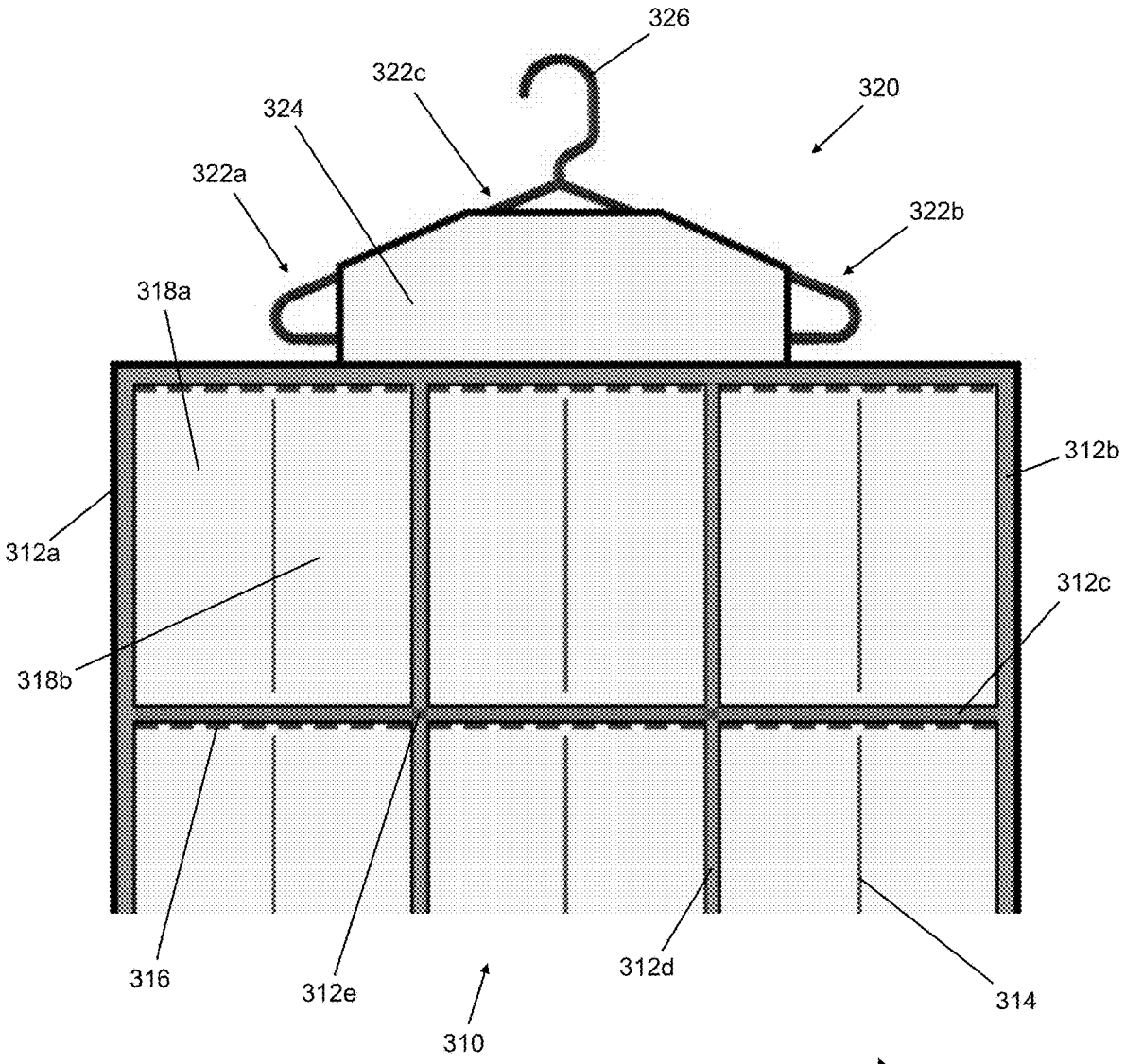
FIG. 3 illustrates a partial plan view of a multipocketed laundry organization device with a hanger inserted within a hanging section and a plurality of pockets having a vertical seam bisecting each pocket in accordance with some embodiments of the present invention.

As shown in FIG. 3, a partial plan view of a multipocketed laundry organization device 300 with a hanger 326 inserted within a hanging section 320 and a plurality of pockets having a vertical seam 314 bisecting each pocket is provided. The multipocketed laundry organization device 300 may comprise an organizational section 310 and a hanging section 320 such that the hanging section 320 may be permanently coupled to the organizational section 310 via stitching at the top edge thereof along a portion of the outer reinforcing member 312*a*.

The organizational section 310 may comprise a plurality of pockets each bisected by a vertical seam 314 into first and second pocket portions 318*a*, 318*b*. Each pocket portion 318*a*, 318*b* may be defined by stitching coupling a first sheet of fabric and a second sheet of fabric together along with a closure element 316. Some or all of the stitching between the first and second fabric sheets may be stitched together using reinforcing members 312*a*-312*e* disposed between the first and second fabric sheets in areas illustrated in dark shading as shown in FIG. 3. Specifically, the outer reinforcing member 312*a* may comprise robustly-reinforced edging that is mechanically reinforced to protect against wear.

For example, the outer reinforcing member 312*a* can be created by utilizing enhanced stitching techniques. This can involve using a stronger thread, such as heavy-duty nylon or polyester thread, and employing reinforced stitching patterns, such as double stitching or triple stitching. These techniques increase the overall strength and durability of the outer edge of the multipocketed laundry organization device 300, providing added reinforcement.

Further, the outer reinforcing member 312*a* can be formed by applying an additional layer of robust material along the outer edge of the organizational section 310 of the device 300. This material can be a strip of reinforced fabric or webbing, such as nylon webbing or canvas, that is securely stitched or bonded to the fabric sheets. The reinforced edging provides extra structural support and helps prevent fraying or tearing along the edges of the device 300.

Another technique to create the outer reinforcing member 312*a* is by using binding tape or piping. This involves attaching a strip of strong and durable material, such as nylon or polyester binding tape or piping, along the outer edge of the organizational section 310 of the device 300. The tape or piping is typically sewn or heat-sealed onto the fabric sheets, providing reinforcement and a clean, finished appearance to the outer edge.

Overlocking or serger stitching can be employed to create the outer reinforcing member 312*a* of the organizational section 310 of the device 300. This technique involves using a specialized sewing machine with multiple threads to stitch, trim, and finish the edges simultaneously. Overlocking or serger stitching helps prevent fraying and strengthens the seam, ensuring that the outer edge of the multipocketed laundry organization device 300 remains intact and resistant to wear.

Additionally, a frame reinforcing member 312*b* may be disposed along a periphery of the organizational section 310 but within the outer reinforcing member 312*a*. The frame reinforcing member 312*b*, along with the horizontal and vertical reinforcing members 312*c*, 312*d*, may be utilized as a means of robustly stitching the first and second fabric sheets together to form the plurality of pockets. Moreover, the crossover reinforcing member 312*e* may be disposed at the point where the horizontal and vertical reinforcing members 312*c*, 312*d* crossover one another. This crossover reinforcing member 312*e* may be similar to that of the outer reinforcing member 312*a* in the manner in which the crossover reinforcing member 312*e* is mechanically reinforced to protect against wear given the corners of the pockets are particularly susceptible to wear and tear from iterative use and machine-washing and drying.

The hanging section 320 may comprise a fabric body 324 having first, second and third apertures 322*a*-322*c* formed therein which allows the hanger 326 to be disposed therein. Specifically, the left corner of the hanger 326 may be disposed through the first aperture 322*a*, the right corner of the hanger 326 may be disposed through the second aperture 322*b*, and the hook of the hanger 326 may be disposed through the third aperture 322*c*. The fabric body 324 may be stitched to the outer reinforcing member 312*a* portion of the organizational section 310. The up-sloping diagonal portion of the fabric body 324 between the first aperture 322*a* and the third aperture 322*c* may rest against the left portion of the hanger 326 while the down-sloping diagonal portion of the fabric body 324 between the second aperture 322*b* and the third aperture 322*c* may rest against the right portion of the hanger 326 in order to allow the hanger 326 to support the weight load of the multipocketed laundry organization device 300.

Figure 4:
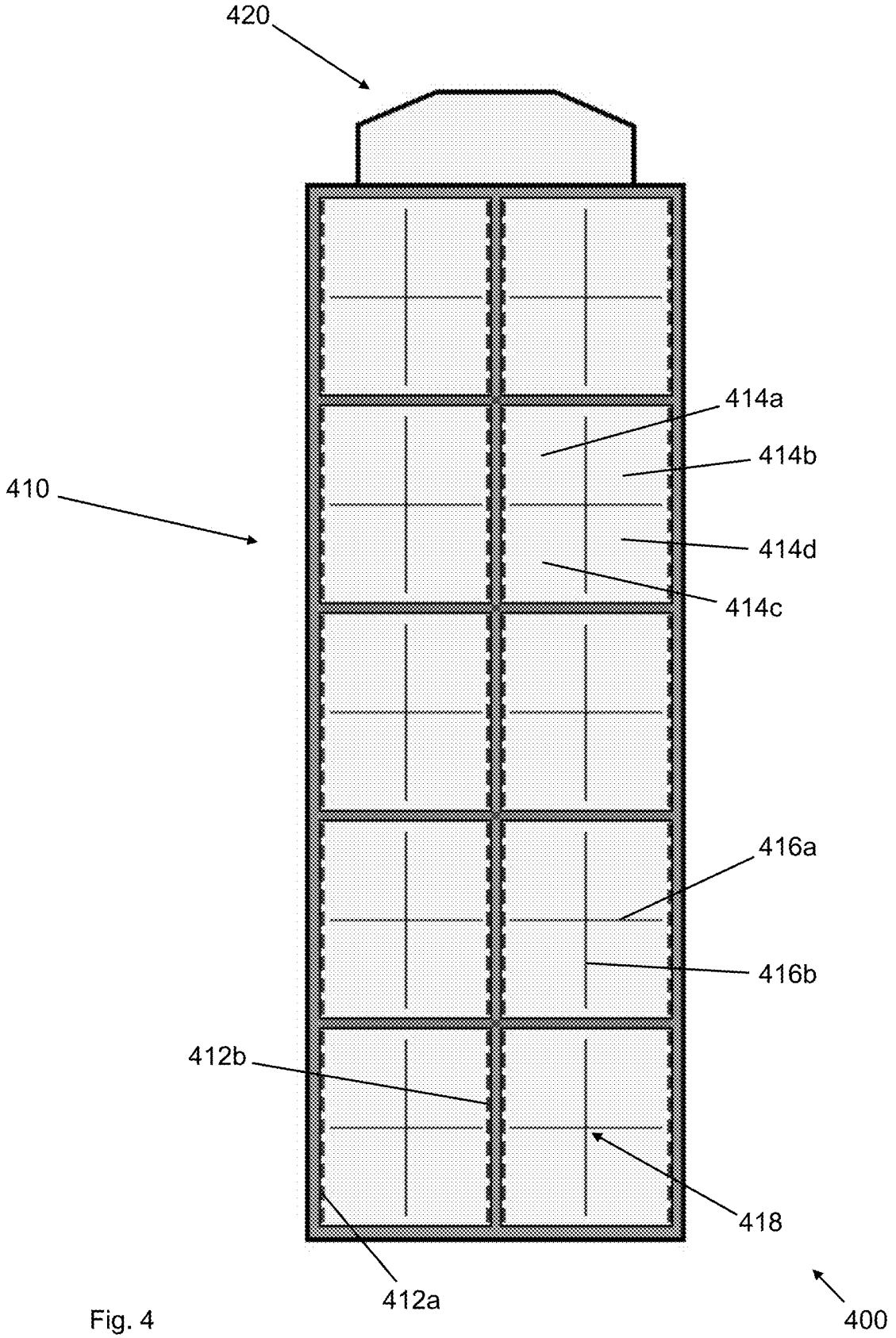
FIG. 4 illustrates a plan view of a multipocketed laundry organization device with a plurality of pockets arranged in two columns having a vertical seam and a horizontal seam bisecting each pocket with closure elements disposed at left and right portions thereof in accordance with some embodiments of the present invention.

As shown in FIG. 4, a plan view of a multipocketed laundry organization device 400 with a plurality of pockets 414*a*-414*d* arranged in two columns having a vertical seam 416*b* and a horizontal seam 416*a* bisecting each pocket with closure elements 412*a*, 412*b* disposed at left and right portions thereof is provided. The multipocketed laundry organization device 400 may comprise an organizational section 410 and a hanging section 420 and may be structurally at least similar to the multipocketed laundry organization device 100 previously described and illustrated with respect to FIG. 1 and similar embodiments.

The multipocketed laundry organization device 400 of FIG. 4 may comprise a first closure element 412*a* disposed along a left edge of the pockets 414*a*, 414*c* and a second closure element 412*b* disposed along a right edge of the pockets 414*b*, 414*d*. The pockets 414*a*-414*d* themselves may be formed by a horizontal seam 416*a* and a vertical seam 416*b* that each bisects the cavity formed by the stitching therearound to form the four pockets 414*a*-414*d* which each have roughly equal surface areas relative one another. A crosspoint 418 at which the horizontal and vertical seams 416*a*, 416*b* may be formed by the overlap thereof in order to provide a more robustly stitched point at the corners of each of the four pockets, 414*a*-414*d* which are particularly susceptible to wear and tear from iterative use and machine-washing and drying. In such an embodiment, a user may access each side of the cavity via first and second closure elements 412*a*, 412*b* in order to stow or remove one or more articles of clothing from each of the four pockets 414*a*-414*d*.

In addition to the embodiment described above, various additional embodiments can be implemented to enhance the functionality and versatility of the multipocketed laundry organization device 400. One such idea involves customizable pocket sizes, allowing users to tailor the dimensions of individual pockets according to their specific needs. This customization can be achieved through the incorporation of adjustable closure elements 412*a*, 412*b* or additional stitching lines within the organizational section 410. By providing the ability to create larger or smaller compartments within the device 400, users can efficiently organize clothing items of varying sizes and types, optimizing storage space and personal preferences.

Another embodiment involves incorporating transparent or translucent fabric materials for the pockets within the multipocketed laundry organization device 400. By utilizing fabric with see-through properties, users can easily identify the contents stored inside each pocket 414*a*-414*d* without the need to open them individually. This transparent or translucent feature adds a visually appealing element to the device while allowing for quick and efficient item retrieval, simplifying the organization process.

To address potential odor concerns, a relevant embodiment may involve integrating odor control technology within the fabric material or pockets 414*a*-414*d* of the organization device 400. This may be achieved by incorporating activated charcoal or antimicrobial agents that absorb and neutralize odors. By implementing this odor control feature, the multipocketed laundry organization device 400 helps maintain the freshness of stored clothing, providing a more pleasant and hygienic environment.

Figure 5:
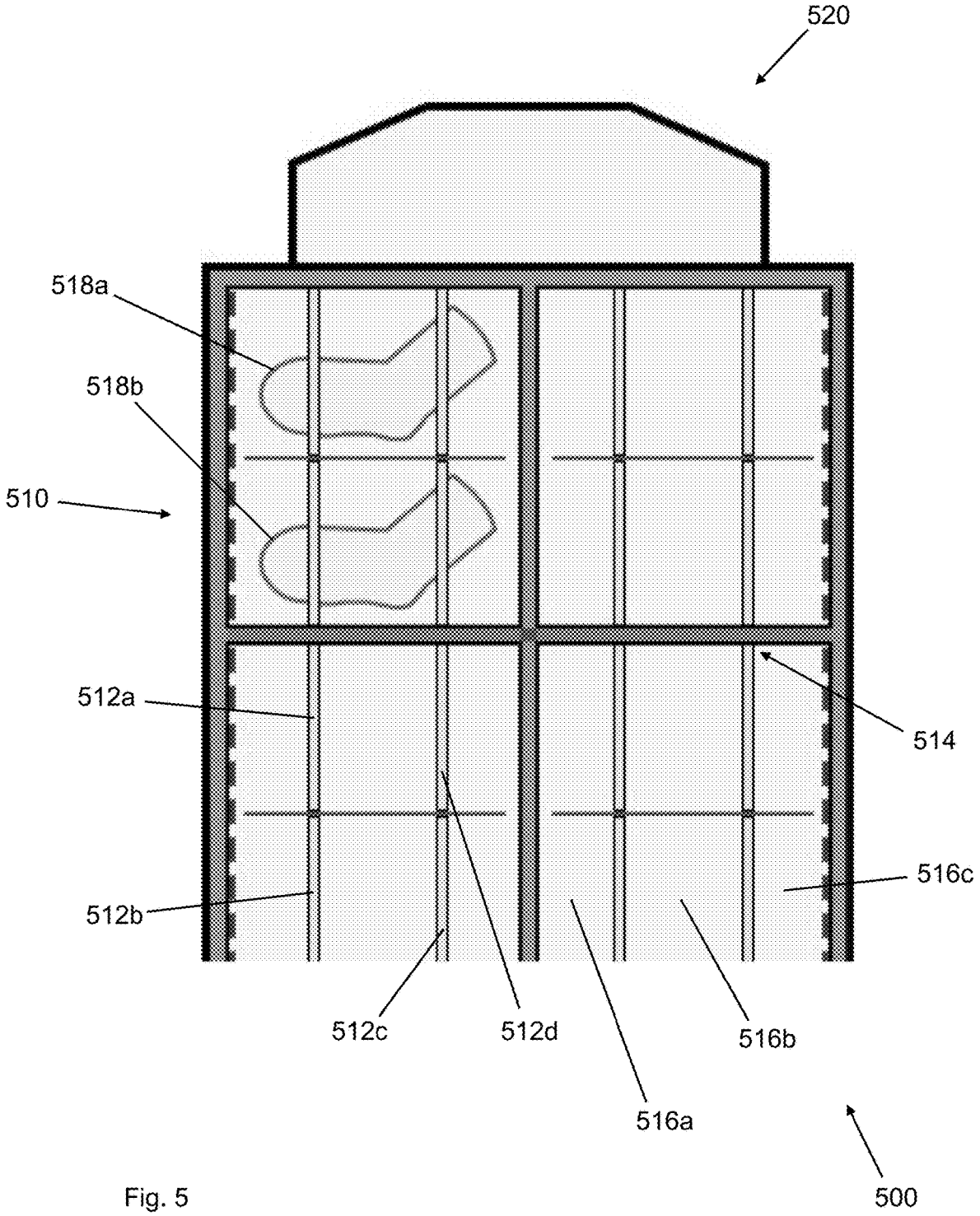
FIG. 5 illustrates a partial plan view of a multipocketed laundry organization device with clothing elements secured by a plurality of retention mechanisms within each bisected portion of a pocket which is bisected via a horizontal seam in accordance with some embodiments of the present invention.

As shown in FIG. 5, a partial plan view of a multipocketed laundry organization device 500 with clothing elements 518*a*, 518*a* secured by a plurality of retention mechanisms 512*a*-512*d* within each bisected portion of a pocket which is bisected via a horizontal seam is provided. The multipocketed laundry organization device 500 may comprise an organizational section 510 and a hanging section 520 and may be structurally at least similar to the multipocketed laundry organization device 100 previously described and illustrated with respect to FIG. 1 and similar embodiments such as that of FIG. 4.

However, the multipocketed laundry organization device 500 may comprise the plurality of retention mechanisms 512*a*-512*d* which may be separated so that two retention mechanisms 512*a*, 512*d* may be disposed within a first bisected portion of the pocket cavity while another two retention mechanisms 512*b*, 512*c* may be disposed within a second bisected portion of the pocket cavity. In such an embodiment, the clothing elements 518*a*, 518*b* may each be secured within respective bisected portions of the pocket cavity. For instance, the clothing element 518*a* may be secured within the first bisected portion via retention mechanisms 512*a*, 512*d* while the clothing element 518*b* may be secured within the second bisected portion via retention mechanisms 512*b*, 512*c*.

The arrangement of the retention mechanisms 512*a*-512*d* within the first and second bisected portions of the pocket cavity creates a first pocket portion 516*a*, a second pocket portion 516*b*, and a third pocket portion 516*c* within each of the first and second bisected portions as shown in FIG. 5. By distributing the pocket portions 516*a*-516*c* in this manner, the clothing elements 518*a*, 518*b* may be robustly secured within the given bisected portion, but not so robustly secured that a user cannot easily remove and reinsert the clothing elements 518*a*, 518*b* from and within the retention mechanisms 512*a*-512*d* as desired in an iterative manner.

The retention mechanisms 512*a*-512*d* may be implemented in many practical forms. For example, the retention mechanisms 512*a*-512*d* can be designed as hook-and-eye closures, commonly used in clothing fastenings. The hook portion can be attached to the pocket portions 516*a*-516*c*, while the eye portion is sewn onto the clothing elements 518*a*, 518*b*. The hooks securely hold the clothing elements 518*a*, 518*b* in place within their respective bisected portions while allowing for convenient removal and insertion. Another option for the retention mechanisms 512*a*-512*d* is the use of magnetic snaps. These snaps consist of magnets enclosed in fabric or plastic casings. When the pocket portions 516*a*-516*c* are brought together, the magnets attract and hold the clothing elements 518*a*, 518*b* securely. The magnetic snaps provide a reliable closure while still enabling easy detachment and reattachment.

Further, the retention mechanisms 512*a*-512*d* can incorporate elastic bands combined with fasteners. Elastic bands can be sewn onto the pocket portions 516*a*-516*c*, and small buckles or clips can be attached to the clothing elements 518*a*, 518*b*. The elastic bands provide tension and hold the clothing elements 518*a*, 518*b* in place, while the fasteners offer a secure closure that can be easily released when needed. Another option is to use buttons and loops as retention mechanisms 512*a*-512*d*. The pocket portions 516*a*-516*c* can have sewn-on loops and buttons in order to secure the clothing elements 518*a*, 518*b*. The buttons can be inserted through the loops to keep the clothing elements 518*a*, 518*b* securely held within their respective bisected portions. This allows for straightforward removal and insertion of the clothing elements 518*a*, 518*b*.

With reference to FIGS. 1-5, the fabric sheets and fabric body of the multipocketed laundry organization device illustrated and described with respect to FIGS. 1-5 may be fabricated as mesh fabric. For instance, the plurality of fabric sheets may be implemented as a plurality of mesh fabric sheets and the fabric body may be implemented as a mesh fabric body. Such mesh fabric may comprise a plurality of pores formed therein that comprise a pore diameter.

An advantageous range for the diameter of the pores in the mesh material of the laundry organization device would balance the need for aeration and the prevention of small clothing items from escaping. While the specific range may vary from the preferred range, an advantageous range for the pore diameter may be between 1 millimeter and 25 millimeters. Pore diameters within this range offer several advantageous benefits. For example, such pore diameters towards the 1 millimeter end of the range are still large enough to allow sufficient airflow and ventilation, promoting effective aeration of the clothes inside the device. This facilitates the circulation of air during machine washing and drying, helping to remove moisture and odors from the garments. At the same time, such pore diameters towards the 25 millimeter end of the range are still small enough to prevent small items from slipping through and getting lost during the washing and drying processes. Further, such pore diameters towards the 25 millimeter end still provide enough of a robust fabric thread count stability to support the load of carrying items within the pockets and the iterative machine washing and drying thereof. Such a range of pore diameters strikes optimizes the balance between allowing air and moisture penetration while maintaining the structural fabric durability of pockets or compartments of the laundry organization device during iterative use and machine washing and drying thereof.

In various embodiments of FIGS. 1-5, the reinforcing members may be embodied as strips or panels of more robust material compared to the fabric sheets. For example, the reinforcing members may be made from materials such as canvas, nylon, polyester, or other suitable fabrics known for their strength and durability. These materials provide enhanced resistance to tearing or stretching, which is essential for maintaining the structural integrity of the device over time. Further, the threads per centimeter of the reinforcing members may be greater than that of the fabric sheets and the fabric body.

An advantageous range of thread count or thread density for the reinforcing members relative to the fabric sheet and fabric body material of the laundry organization device may be as follows. For the reinforcing members, a higher thread count or thread density of between 20 and 200 threads per centimeter is advantageous to provide sufficient strength and reinforcement. Anything less than 20 threads per centimeter would not provide enough robust reinforcement of the fabric body material during machine wash and dry cycles. However, anything more than 200 threads per centimeter would provide diminishing returns given the added cost of fabricating such densely threaded reinforcing members.

A higher thread count or thread density ensures that the reinforcing members are tightly woven and densely stitched, contributing to the overall durability and stability of the laundry organization device. The increased number of threads per unit length enhances the load-bearing capacity and resistance to wear and tear. However, it is important to balance the thread count or thread density with the properties of the fabric sheets and fabric body material itself. The fabric sheets and fabric body may have a thread count or thread density of between 10 and 100 threads per centimeter to provide strength and support while also providing optimal aeration and fluid flow therethrough. Anything less than 10 threads per centimeter would not provide enough durability for fabric sheets and fabric body material during machine wash and dry cycles. However, anything more than 100 threads per centimeter would provide diminishing returns given the added cost of fabricating such densely threaded fabric sheets and fabric body. Therefore, an advantageous range of relative thread count or thread density between the reinforcing members and the fabric sheet and fabric body material of the laundry organization device may be between 20 to 1 and 2 to 1 for the reasons described in this and the preceding paragraph.

With further reference to FIGS. 1-5, the laundry organization device may constructed using durable and resilient materials to ensure its ability to withstand repeated machine-washing and drying cycles without exhibiting wear and deformation. High-quality fabrics, such as polyester blends or nylon, known for their strength and resistance to wear, are utilized in the manufacturing process. These materials provide the necessary durability to withstand the rigors of machine-washing and drying, ensuring the longevity of the device.

Further, to enhance the structural integrity of the laundry organization device, reinforced stitching techniques may be employed throughout its construction. Special attention may be given to high-stress areas and seams, where double stitching or reinforced stitching may be implemented using strong and durable thread. By reinforcing the stitching, the risk of unraveling or tearing during machine-washing and drying may be significantly minimized, allowing the device to maintain its shape and functionality over multiple cycles.

The laundry organization device may feature reinforced edges along its openings, seams, and pockets. Additional layers of fabric, binding tape, or stitching reinforcements may be incorporated to prevent fraying and maintain the structural integrity of the device during machine-washing and drying. The reinforced edges may ensure that the device remains intact and resilient, even under the mechanical stresses imposed by the washing and drying processes.

The design of the laundry organization device may incorporate a smooth surface without sharp edges or protruding elements that could become entangled or caught in the washing machine or dryer. By eliminating potential snag points, the risk of damage to the device may be significantly reduced. This smooth surface design allows the device to move freely within the washing machine and dryer, ensuring that it retains its shape and functionality throughout the washing and drying cycles.

With further reference to FIGS. 1-5, the form factor of the laundry organization device may be designed with appropriate dimensions, size, and flexibility to fit comfortably within standard washing machines and dryers. By considering the specific size and shape requirements, the device can freely circulate and move with the laundry load during machine-washing and drying. Specifically, the laundry organization device may utilize one or more mechanisms to reduce the form factor to minimize excessive compression or distortion of the device, preserving its structural integrity and functionality over time.

For example, the device could incorporate a folding mechanism that allows it to be compactly folded or collapsed into a smaller form factor. This folding mechanism may involve hinged sections or flexible panels that enable the device to be easily folded or unfolded when transitioning between storage and machine-washing configurations. The folding mechanism could be designed to reduce the overall size of the device, minimizing the chances of stress or deformation during iterative machine wash and dry cycles.

In another example, a snap button or other fastening system can be incorporated into the laundry organization device to secure it in the folded configuration. Snap buttons, hook-and-loop fasteners, or other secure fastening mechanisms can be strategically placed along the peripheral edges of the organization section (e.g. at lengthwise and widthwise midpoints thereof, at corners thereof etc.) to hold the device firmly in its reduced form factor. This ensures that the device remains compact during machine wash and dry cycles, reducing the potential for stress or damage due to winding around other items during a spin process.

In a further example, elastic bands or straps can be integrated into the design of the laundry organization device to hold it securely in the folded configuration. These bands or straps can be stretched or tightened around the device to keep it compact and prevent it from unfolding or expanding during machine wash and dry cycles. The elasticity of the bands or straps allows them to adapt to the varying dimensions of the folded device, ensuring a snug fit and reducing stress on the material thereof.

The specification and drawings are to be regarded in an illustrative rather than a restrictive sense. However, it will be evident that various modifications and changes may be made thereunto without departing from the broader spirit and scope of the invention as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All features disclosed in the specification, claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise.

Throughout this disclosure, the phrase 'modularly coupled' and similar terms and phrases are intended to convey that any element of a given class of elements may be coupled to another given element and vice versa with equal effect. For example, any extension cord of a plurality of extension cords may be modularly coupled to another extension cord and vice versa with equal effect. Further, throughout this disclosure, the phrase 'removably coupled' and similar terms and phrases are intended to convey that a given element may be iteratively coupled to and removed from another given element as desired. For example, a male plug of a first extension cord may be removably coupled to a female plug of a second extension cord as desired.

The use of the terms "a," "an," "the," and similar referents in the context of describing the disclosed embodiments (especially in the context of the following claims) are to be construed to cover both the singular and the plural, unless otherwise indicated or clearly contradicted by context. The terms "comprising," "having," "including," and "containing" are to be construed as open-ended terms (i.e., meaning "including, but not limited to,") unless otherwise noted. The term "coupled" or "connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," is understood with the context as used in general to present that an item, term, etc., may be either A or B or C, or any nonempty subset of the set of A and B and C, unless specifically stated otherwise or otherwise clearly contradicted by context. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, although above-described elements may be described in the context of certain embodiments of the specification, unless stated otherwise or otherwise clear from context, these elements are not mutually exclusive to only those embodiments in which they are described; any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

The invention claimed is:

1. A multipocketed laundry organization device, comprising:

an organizational section comprising two fabric sheets coupled together at a plurality of coupling locations, wherein:

each of the two fabric sheets are disposed on opposing sides of one or more reinforcing members, the one or more reinforcing members are fabricated from a first material and the two fabric sheets are fabricated from a second material, the first material is different than the second material and the first material comprises a higher resistance to tearing and stretching relative the second material, the plurality of coupling locations at least in part define a shape of a plurality of pockets, the one or more reinforcing members comprise a vertical reinforcing member disposed vertically between two columns of the plurality of pockets, the vertical reinforcing member couples together adjacent interior side edges of the two columns of the plurality of pockets, and each of the plurality of pockets comprises a cavity and a closure element; and a hanging section comprising a fabric body, wherein:

the fabric body comprises a left side aperture, a top aperture, a right side aperture and first and second load-bearing portions, the first load-bearing portion has an upwardly-sloped shape and is disposed between the left side aperture and the top aperture, the second load-bearing portion has a downwardly-sloped shape and is disposed between the top aperture and the right side aperture, and the two fabric sheets and the one or more reinforcing members extend from the hanging section to a bottom peripheral edge of the organizational section.

2. The multipocketed laundry organization device of claim 1, wherein the two fabric sheets are coupled together by a plurality of stitch seams.

3. The multipocketed laundry organization device of claim 2, wherein the plurality of stitch seams couple the two fabric sheets around the one or more reinforcing members.

4. The multipocketed laundry organization device of claim 2, wherein the plurality of stitch seams are disposed at the plurality of coupling locations.

5. The multipocketed laundry organization device of claim 1, wherein the one or more reinforcing members are disposed along a peripheral edge of the organizational section.

6. The multipocketed laundry organization device of claim 1, wherein the one or more reinforcing members are disposed between rows of the plurality of pockets of the organizational section.

7. The multipocketed laundry organization device of claim 1, wherein each of the plurality of pockets comprise a bisecting seam extending from a top surface of each of the plurality of pockets to a bottom surface of each of the plurality of pockets and along an axis running through a widthwise midpoint of each of the plurality of pockets.

8. The multipocketed laundry organization device of claim 7, wherein the bisecting seam defines two pocket portions adjacent one another.

9. The multipocketed laundry organization device of claim 8, wherein the two pocket portions have equal dimensions.

10. The multipocketed laundry organization device of claim 1, wherein the cavity of each pocket is accessed via an opening in the closure element.

11. The multipocketed laundry organization device of claim 10, wherein the closure element comprises a closed state and an open state.

12. The multipocketed laundry organization device of claim 11, wherein:

the cavity is not accessible when the closure element is in the closed state, and the cavity is accessible via the opening when the closure element is in the open state.

13. The multipocketed laundry organization device of claim 11, wherein the opening only exists when the closure element is in the open state.

14. The multipocketed laundry organization device of claim 1, wherein the hanging section is permanently coupled to the organizational section.

15. The multipocketed laundry organization device of claim 1, wherein the hanging section is removably coupled to the organizational section.

16. A multipocketed laundry organization device, comprising:

an organizational section comprising two fabric sheets coupled together at a plurality of coupling locations, wherein:

each of the two fabric sheets are disposed on opposing sides of one or more reinforcing members, the one or more reinforcing members are fabricated from a first material and the two fabric sheets are fabricated from a second material, the first material is different than the second material and the first material comprises a higher resistance to tearing and stretching relative the second material, the plurality of coupling locations at least in part define a shape of a plurality of pockets, the one or more reinforcing members comprise a vertical reinforcing member disposed vertically between two columns of the plurality of pockets, the vertical reinforcing member couples together adjacent interior side edges of the two columns of the plurality of pockets, each of the plurality of pockets comprises a cavity and a closure element, the cavity of each pocket is accessed via an opening in the closure element, and the cavity of each pocket comprises at least one retention mechanism disposed therein; and a hanging section comprising a fabric body, wherein:

the fabric body comprises a left side aperture, a top aperture, a right side aperture and first and second load-bearing portions, the first load-bearing portion has an upwardly-sloped shape and is disposed between the left side aperture and the top aperture, the second load-bearing portion has a downwardly-sloped shape and is disposed between the top aperture and the right side aperture, and the two fabric sheets and the one or more reinforcing members extend from the hanging section to a bottom peripheral edge of the organizational section.

17. A multipocketed laundry organization device, comprising:

an organizational section comprising two fabric sheets coupled together at a plurality of coupling locations, wherein:

each of the two fabric sheets are disposed on opposing sides of one or more reinforcing members, the one or more reinforcing members are fabricated from a first material and the two fabric sheets are fabricated from a second material, the first material is different than the second material and the first material comprises a higher resistance to tearing and stretching relative the second material, the plurality of coupling locations at least in part define a shape of a plurality of pockets, the one or more reinforcing members comprise a vertical reinforcing member disposed vertically between two columns of the plurality of pockets, the vertical reinforcing member couples together adjacent interior side edges of the two columns of the plurality of pockets, and each of the plurality of pockets comprises a cavity and a closure element; and a hanging section comprising a fabric body, wherein:

the fabric body comprises a left side aperture, a top aperture, a right side aperture and first and second load-bearing portions, the first load-bearing portion has an upwardly-sloped shape and is disposed between the left side aperture and the top aperture, the second load-bearing portion has a downwardly-sloped shape and is disposed between the top aperture and the right side aperture, the two fabric sheets and the one or more reinforcing members extend from the hanging section to a bottom peripheral edge of the organizational section, the hanging section is coupled to the organizational section at a top peripheral edge of the organizational section, and the coupling of the hanging section to the organizational section in part defines a hanger cavity within the fabric body.

* * * * *